United States Patent [19]

Eberle

[11] 4,189,011

[45] Feb. 19, 1980

[54] HAMMER DRILL

[75] Inventor: Robert Eberle, Nürtingen, Fed. Rep. of Germany

[73] Assignee: Metabowerke GmbH & Co., Nurtingen, Fed. Rep. of Germany

[21] Appl. No.: 893,356

[22] Filed: Apr. 4, 1978

[30] Foreign Application Priority Data

Apr. 7, 1977 [DE] Fed. Rep. of Germany ..... 2715682

[51] Int. Cl.[2] ..... B23Q 5/027; E02D 7/02

[52] U.S. Cl. ..... 173/13; 173/48; 173/97

[58] Field of Search ..... 74/22 R, 22 A, 56; 76/DIG. 2; 173/13, 48, 94–97, 123; 308/30, 189 R, 207 R

[56] References Cited

U.S. PATENT DOCUMENTS

| | | | |
|---|---|---|---|
| 1,895,540 | 1/1933 | Cohen | 308/189 R X |
| 2,799,035 | 7/1957 | Pfluger | 74/56 X |
| 3,225,610 | 12/1965 | Binder | 74/56 |
| 3,680,642 | 8/1972 | Kirn et al. | 173/48 X |
| 3,693,728 | 9/1972 | Stroezel | 173/48 |
| 3,789,933 | 2/1974 | Jarecki | 173/48 |
| 4,090,747 | 5/1978 | Jensen | 308/30 |

FOREIGN PATENT DOCUMENTS

| | | | |
|---|---|---|---|
| 1204126 | 10/1965 | Fed. Rep. of Germany | 173/48 |
| 2531699 | 2/1977 | Fed. Rep. of Germany | 308/189 R |
| 98337 | 6/1961 | Netherlands | 74/22 |

*Primary Examiner*—Lawrence J. Staab
*Attorney, Agent, or Firm*—Michael J. Striker

[57] ABSTRACT

A hammer drill has a housing and a spindle mounted on the housing for rotating and reciprocating longitudinal movement. The spindle has a leading end provided with an end portion extending outward through a hole in the housing, facing a wall to be drilled. The housing is provided with a motor rotating the spindle and a member which subjects the spindle, when the latter rotates, to reciprocating longitudinal movement.

24 Claims, 4 Drawing Figures

HAMMER DRILL

BACKGROUND OF THE INVENTION

The present invention relates to hammer-drill devices.

In German allowed application No. 2 110 015 a hammer drill has been proposed which has a hammer-drill spindle mounted in a housing on a bush provided in an intermediate wall. The bush according to above-mentioned application has been provided with a plurality of projections. It is to be understood that making and installing this bush is relatively expensive and rather complicated. Inasmuch as the bush is a rotatable element, it involves, simultaneously, relatively great material consumption.

It is further known in the art to mount an armature shaft of a driving motor and a spindle in a sintered stainless element, on which a plurality of projections is provided. In this case, also, the making of such device involves relatively great time and material consumption.

SUMMARY OF THE INVENTION

It is a general object of the present invention to avoid the disadvantages of the prior art hammer-drill devices.

More particularly, it is an object of the present invention to provide an inexpensive hammer drill which can be economically produced and still have a material-saving construction of projections.

These objects are attained according to the present invention by providing a hammer drill which has a housing having at a leading end which faces a wall to be drilled a throughout-going hole, a spindle longitudinally extended in the housing toward the hole. The spindle is rotated in the housing by means for rotating, for example a motor, driving shaft connected with the motor and gearing train translating the rotatable movement from the motor through the driving shaft to the spindle, which has a leading end provided with an end portion extending outward through the hole in the housing. The spindle is also subjected to reciprocating longitudinal movement in the housing. To accomplish this movement the housing is provided with a first element of shaped sheet material which is fixedly mounted in said housing, for example on an intermediate wall, and provided with a first annulus of circumferentially spaced projections, which are surface hardened, for example case-hardened.

The housing is further provided with a second element fixedly mounted on the spindle adjacent to the first element and having a second annulus of circumferentially spaced projections facing toward the first annulus of projections. The second element may, for example, be provided on a gear mounted on the spindle for taking up a rotatable movement from the driving shaft.

Due to making of the first element with projections of shaped material only small material consumption is necessary without requiring any further machining of this element. Another advantageous feature of this invention resides in using inexpensive and light material, which fact not only reduces the expenses but simultaneously decreases the weight of the construction without reduction of durablity of the construction or reduction of transmitted energy necessary to accomplish a hammer-drill operation.

Another advantageous feature of the present invention resides in providing the housing with resilient means for biasing the second element away from the first element so that when the end portion of the spindle abuts a wall to be drilled, under a force applied by an operator, the second element moves toward the first element counter to the force of the resilient means so that the projections of the first annulus engage with the projections of the second annulus and alternatively enter into and move out of recesses between the projections of the first annulus when the spindle rotates, to thereby subject the spindle to reciprocating longitudinal movement. The resilient means, for example a spring, can be placed between the first and the second elements or elsewhere.

According to a further advantageous feature of the present invention, the circumferentially spaced projections on the first element are made by cold-pressing the first element, and at least the outer surface of the projections is preferably case-hardened.

Still another advantageous feature of the present invention resides in providing a support for the spindle (which support is coaxial with the first annulus of projections) in the first element. Such a construction renders it possible to achieve a very inexpensive construction of the spindle support, which constructions renders it possible to facilitate the installation of the support. To accomplish this, the first element is substantially Z-shaped, where a first leg is provided with the first annulus of projections, a second leg axially spaced from the first leg and is transversal to a longitudinal axis of the spindle defining a hole in the first element for permitting a trailing end of the spindle to come therethrough, the first and the second legs are connected to each other by a surface substantially parallel to the longitudinal axis of the spindle and this surface serves as an outer race for a roller body, for example a ball with or without a cage. A transition zone between the surface and the second leg is adopted to correspond to a radius of the ball.

The first element can be very thin and yet provided with sufficient rigidity, if the element has a U-shaped cross-section with the bent legs. The first element can be placed on an intermediate wall between the driving motor and the gear train to thereby exclude rotation of the first element.

In the preferred embodiment the first element is of one piece made of shaped sheet sheet material with the intermediate wall operative also to carry the support for the spindle and placed between the driving motor and the gear train. Such a wall made of, for example, plastic resin divides the housing into two parts. The housing is provided with projections to define a space therebetween for closely receiving the wall in the space.

An especially inexpensive and yet stable construction renders it possible, when the intermediate wall is made of shaped sheet material to provide the wall with a portion for receiving a support for the spindle and a portion to form the projections thereon and further to provide it with a throughgoing opening for a support of an armature shaft and an opening for a support for an intermediate shaft.

When the portions for supports are very close on the intermediate wall, the latter can be formed of two shaped sheet material plates connected to each other, where the first plate is provided for carrying thereon the support for the spindle and projections, and the second is provided with a recess for the armature shaft support, so that the armature shaft comes through both plates. The recess can be made of such dimensions that no special support bush has to be used to install the latter in such a recess, and yet renders it possible to achieve an accurate and stable support.

To convert the hammer drill from the hammer-drilling mode to simple drilling mode, it is advantageous to mount on the armature shaft a stop plate. This stop plate can be mounted tiltably on the shaft, and be provided with an opening through which the trailing end of the spindle comes during reciprocating movement when this opening is in alignment coaxial with the opening in the first element, and which plate normally closes the opening in the first element to thereby not permit the spindle to come therethrough. The corresponding movement of the stop plate can be considerably facilitated by providing the housing with a slide plate.

To further reduce the expenses and the weight of the device a support of the leading end of the spindle can also be formed of shaped sheet material having a cup-shape, so that in the same manner already described above the support of the leading end is provided with a roller body placed in the support carrying the spindle. The outer dimensions of this support can be made to correspond to standardized sizes of ball bearings and such a support is positioned in a recess provided in the housing so that this recess can be used for supporting thereon a conventional type of ball bearing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
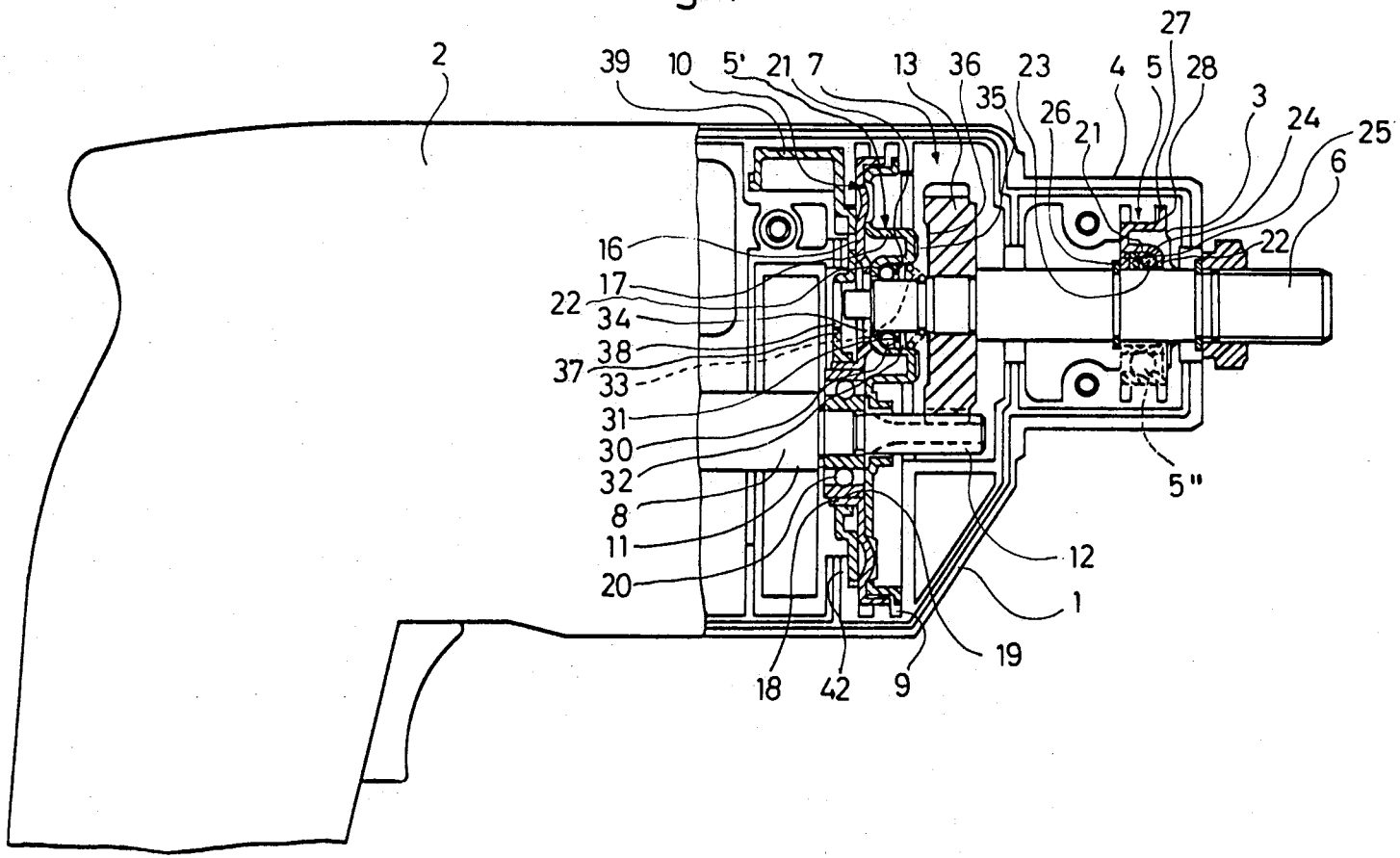
FIG. 1 is a sectional view of a hammer-drill according to the present invention, showing the intermediate wall comprising two plates, provided with an annulus of projections.

Referring now to the drawings and first to FIG. 1 thereof, it may be seen that a housing of a hammer drill comprises two halves designated by reference numerals 1 and 2. The housing is provided with a recess 3 in a spindle collar 4, in which there is placed a support element 5 made of shaped sheet material for support the leading end of a spindle 6.

To separate a gear train 7 from a driving motor 8 in intermediate wall 10 is provided in a recess 9 of the halves 1 and 2. In this wall there are supported a trailing end of the spindle 6 and an armature shaft 11. The armature shaft 11 extends with its end portion provided with a pinion portion 12 through the intermediate wall 10. The pinion portion 12 is engaged with a gear 13 fixedly mounted on the spindle 6.

In the embodiment shown in FIG. 1 the intermediate wall 10 consists of two plates 16 and 17 both made of shaped sheet material. The plate 16 is provided with a receiver 18 that is formed by upsetting a part 19 of the plate, and in the thus formed receiver 18 a support (e.g., anti-friction bearing or simply bearing balls 20) for the armature shaft 11 can be installed, to support the leading end of the spindle 6 the support element 5 has a cup-shaped and U-shaped cross-section. The surface 21 which is parallel to a longitudinal axis of the spindle 6 merger via rounded portion into a bent portion 22, so that the radius of the roundness corresponds to a radius of a ball 23 positioned and carried therein and through which radial forces which occur on the spindle 6 are transmitted to the surface 21 and further to the housing of the device.

To guarantee a secure position of the ball 23 in axial direction there are two disks 24 and 25 mounted on the spindle 6 and they are secured by a locking ring 26. The cup-shaped support element 5 is surface-hardened, so that the ball 23 has a smooth, hardened running race about the surface without any additional machinery of the latter. To achieve a better support effect of the support element 5 in the housing, the element 5 is provided with a flange 27, which abuts an interface 28 of the recess 3 with a small surface pressure.

Figure 2:
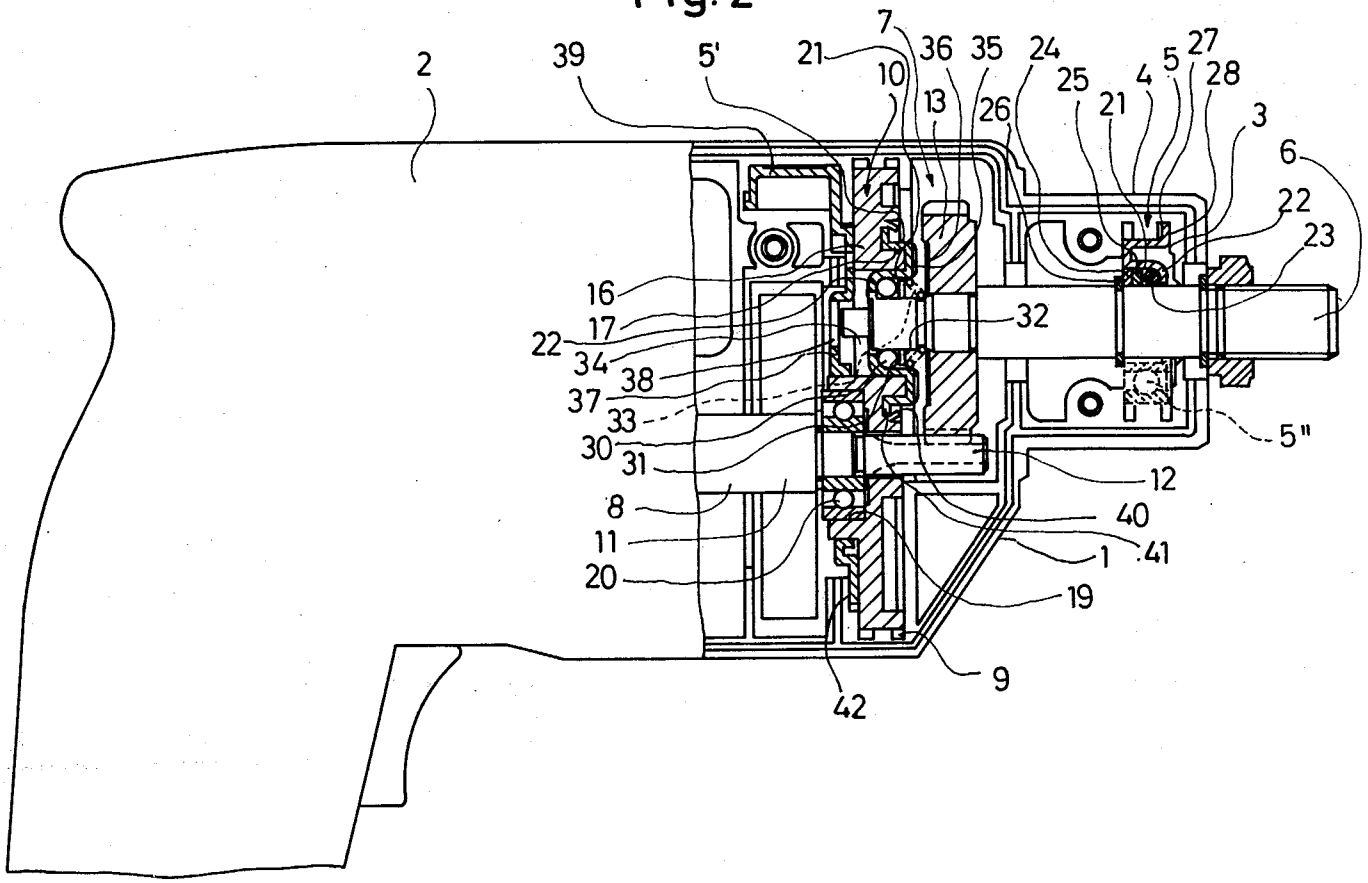
FIG. 2 is another embodiment of the hammer-drill shown in FIG. 1.

The dimensional sizes of the support element 5 correspond to those of standardized ball bearings, so that the support element 6 can at any time as is shown in FIG. 1 and in FIG. 2, without any supplemental alterations be substituted by a conventional bearing 5''.

For making an opposed support for the spindle 6 there is formed on the plate 17 a support element 5' which similar to that designated by reference numeral 5. The support element 5' is provided with a ball 30 which is placed in a case closed by two rings 31 and 32 which are biased against the ball 30 by a spring 33. The spindle 6 is movable through an opening 34 in the plate 16 counter to the force of the spring 33. During such a movement projections provided on the element 5' engage with projections which correspond to the projections on the element 5 and which are provided on the gear 13, and alternatively during rotation of the spindle 6 they enter into and move out of recesses between the projections of the element 5' to thereby subject the spindle 6 to reciprocating longitudinal movement thus to carry out the drilling operation in a wall. The support element 5' can be formed together with projections 35 during one and the same forming operation, namely during making the plate 17. To prevent abrasion and wear of the plate 17, it can be surface hardened as a whole, or at least in the areas of the support and projections.

To prevent axial movement of the spindle 6 there is tiltably provided on the flange of the recess 19 a stop plate 37. In one position, the trailing end of the spindle 6 moves through an opening 38 in the stop plate 37, while in the other position of the stop plate 37 the trailing end of the spindle 6 abuts the plate 37, so that the drilling operation is accomplished without hammering. Tilting movement of the stop plate 37 is accomplished by a slide plate 39 mounted in the housing.

The embodiment shown in FIG. 2 differs from that shown in FIG. 1 only by a different type of the intermediate wall 10. In this embodiment the wall 10 is solid and placed in a recess 40 of the element 5' where the wall 10 is secured against rotation and falling out by bending the marginal portion of the element 5'. To secure rotation of the element 5', the latter for example can be formed having a square periphery and a marginal portion 41 which is bent and lodged in the recess 40. In both embodiments the stop plate 37 is tiltable by movable projections 42 of the halves 1 and 2.

Figure 3:
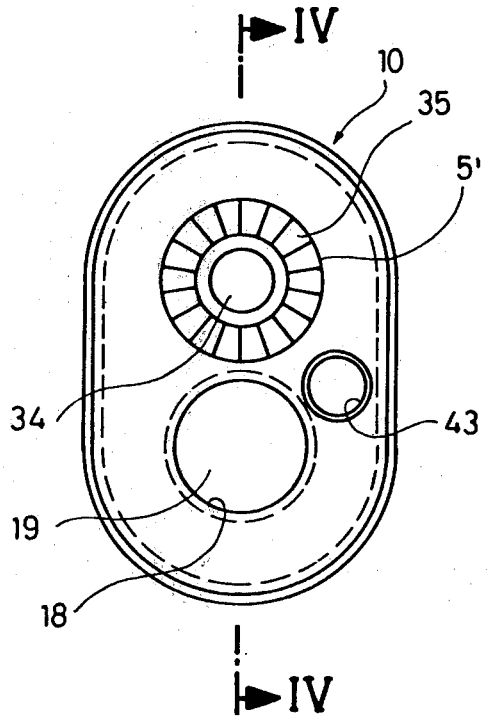
FIG. 3 is a view of the intermediate wall provided with the annulus of circumferentially spaced projections.
Figure 4:
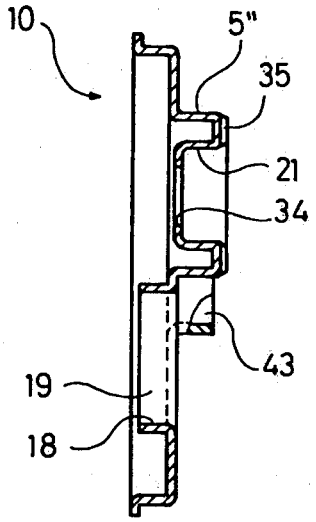
FIG. 4 is a sectional view taken along the line IV—IV of FIG. 4.

Another type of intermediate wall 10 is shown in FIGS. 3 and 4. This embodiment is provided for a hammer drill having an intermediate shaft. The wall 10 according to this embodiment is solid. On one side of the wall there is provided the element 5' with the opening 34 for receiving the support for the trailing end of the spindle and the annulus 35 of circumferentially spaced projections. For supporting the armature shaft the flange of the recess 19 is provided on the other side of the wall to thereby provide the receiving portion 18 for receiving a support for supporting the armature shaft. Adjacent to and laterally spaced from the recess 19 there is provided on the wall 10 an opening 43 for receiving the intermediate shaft.

It will be understood that each of the elements described above, or two or more together, may also find a useful application in other types of hammer drills differing from the types described above.

While the invention has been illustrated and described as embodied in a hammer drill, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential charcateristics of the generic or specific aspects of this invention.

What is claimed as new and desired to be protected by Letters Patent is set forth in the appended claims.

I claim:

1. A hammer-drill comprising a housing having a leading end facing a wall to be drilled, said leading end being provided with a throughgoing hole; a spindle longitudinally extended in the housing toward said hole, said spindle being mounted in said housing for rotating and for reciprocating longitudinal movement, and having a leading end provided with an end portion extending outwardly through said hole in the housing and a trailing end; means in said housing for rotating said spindle and including an armature shaft and an intermediate shaft connecting said armature shaft with said spindle; means in said housing for reciprocating said spindle, including a first element of shaped sheet material fixedly mounted in said housing and provided with a first annulus of circumferentially spaced projections, a second element fixedly connected to said spindle adjacent to said first element and provided with a second annulus of circumferentially spaced projections facing toward said first annulus of projections; resilient means in said housing and normally biasing said second element axially away from said first element so that, when the end portion of the spindle abuts a wall to be drilled under a force applied by an operator said second element moves toward said first element counter to the biasing force of said resilient means, so that the projections of said first annulus engage with the projections of said second annulus and alternatively enter into and move out of recesses between the projections of said first annulus when the spindle rotates, to thereby subject the spindle to reciprocating longitudinal movement; and a supporting wall of shaped sheet material fixedly mounted on the housing and having an internal recess for receiving said first element of shaped sheet material, said first element being rigidly lodged into said recess of the wall, said wall being provided with a first portion for receiving a support for the trailing end of the spindle a second portion adjacent to the first portion for forming thereon said first annulus of projections, at least one throughgoing recess for receiving a support for supporting said armature shaft and a third portion for receiving a support for supporting said intermediate shaft.

2. A hammer-drill as defined in claim 1, wherein said wall comprises a first shaped sheet plate provided with said first portion and said second portion and a second shaped sheet plate connected with the first plate and provided with said recess for receiving said support for supporting said armature shaft, so that said armature shaft goes through said both plates.

3. A hammer-drill as defined in claim 2, wherein said wall has an opening for receiving the trailing end of said spindle further comprising a member tiltably mounted in the housing, said member including a plate normally closing said opening in said wall and having a throughgoing hole for permitting said spindle to go through said opening during reciprocating said spindle when said hole is in alignment coaxial with said opening in said first element.

4. A hammer-drill as defined in claim 3, further comprising means in said housing for tilting said tiltable member.

5. A hammer-drill comprising a housing having a leading end facing a wall to be drilled, said leading end being provided with a throughgoing hole; a spindle longitudinally extended in the housing towards said hole, said spindle being mounted in said housing for rotating and for axial reciprocating movement, and having a trailing end and a leading end which is provided with an end portion extending outwardly through said hole in the housing; means in said housing for rotating said spindle, including a rotatable shaft having a first end portion and operatively connected to said spindle for rotating the latter; a supporting element of one piece mounted in said housing and having a first portion operative for supporting said trailing end of said spindle and a second portion operative for supporting said first end portion of said shaft; and means in said housing for reciprocating said spindle and including a first annulus of circumferentially spaced projections formed on said first portion of said one piece supporting element and a member fixedly connected to said spindle adjacent to said first portion of said supporting element and provided with a second annulus of circumferentially spaced projections facing towards said first annulus of projections so that when the end portion of said spindle abuts a wall to be drilled under a force applied by an operator said member moves towards said supporting element so that the projections of said first annulus engage with projections of said second annulus and alternately enter into and move out of recess between the projections of said first annulus when the spindle rotates, to thereby subject the spindle to said axial reciprocating movement.

6. A hammer-drill as defined in claim 5, wherein said first annulus of circumferentially spaced projections on the first portion is made by a cold pressing of said supporting element.

7. A hammer-drill as defined in claim 5, wherein said first annulus of circumferentially spaced projections on the supporting element is surface hardened.

8. A hammer-drill as defined in claim 7, wherein at least a surface provided with said projections of said supporting element is case-hardened.

9. A hammer-drill as defined in claim 5, wherein said first portion is provided with an opening coaxial with said spindle for receiving therethrough said trailing end of the spindle.

10. A hammer-drill as defined in claim 9, wherein said supporting element has a portion of substantially Z-shape provided with a first leg substantially transverse to a longitudinal axis of the spindle for carrying said first annulus of projections, a second leg defining said opening in the supporting element and substantially transverse to said longitudinal axis of the spindle and axially spaced from said first leg, and a surface for connecting said legs and being substantially parallel to said axis of the spindle and laterally spaced from said spindle for receiving a support in a space defined by said spindle and laterally spaced surface for supporting said trailing end of the spindle.

11. A hammer-drill as defined in claim 10, wherein said supporting element further comprises a transition zone between said second leg and said connected surface, said support comprises a roller body abutting said transition zone shaped corresponding to said roller body to thereby operate as an outer race for the roller body placed on the spindle operative as an inner race.

12. A hammer-drill as defined in claim 5, wherein said supporting element has a portion substantially U-shaped cross-section.

13. A hammer-drill as defined in claim 5, further comprising a support in said housing for supporting said leading end of the spindle.

14. A hammer-drill as defined in claim 13, wherein said support is of shaped sheet material.

15. A hammer-drill as defined in claim 14, wherein said support has an annular shape to thereby provide an outer race for a roll body placed on the spindle operative as an inner race for said roller body.

16. A hammer-drill as defined in claim 15, wherein said outer race is surface-hardened.

17. A hammer-drill as defined in claim 16, wherein said outer race is case-hardened.

18. A hammer-drill as defined in claim 17, wherein said support has a portion of U-shape cross-section having a portion substantially parallel to said spindle, a portion connected to said parallel portion and substantially transverse to said spindle, and transition zone between said two portions adapted to correspond to said roller body.

19. A hammer-drill as defined in claim 17, wherein said housing further comprises a recess for mounting thereon said support for the leading end of the spindle.

20. A hammer-drill as defined in claim 13, wherein said support is an antifriction bearing.

21. A hammer-drill as defined in claim 5, wherein said first end portion of said shaft constitutes a pinion portion, and said rotating means further including a gear rigidly mounted on said spindle, said gear being permanently engaged with said pinion portion of said shaft.

22. A hammer-drill as defined in claim 21, wherein said member constitutes said gear.

23. A hammer-drill as defined in claim 21, wherein said second annulus is fixedly mounted on a lateral surface of said member rigidly mounted on said spindle, said lateral surface facing toward said supporting element.

24. A hammer-drill as defined in claim 21, wherein said resilient means is a spring mounted between said supporting element and said member.

* * * * *